US009268250B2

(12) United States Patent
Ishikawa et al.

(10) Patent No.: US 9,268,250 B2
(45) Date of Patent: Feb. 23, 2016

(54) IMAGE FORMING APPARATUS THAT MATCHES LASER LIGHT EMISSION TIME TO PULSE WIDTH OF IMAGE PULSE SIGNAL

(71) Applicant: Konica Minolta, Inc., Chiyoda-ku (JP)

(72) Inventors: Akimasa Ishikawa, Toyokawa (JP); Tatsuya Eguchi, Toyohashi (JP); Yohei Yamada, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/066,922

(22) Filed: Oct. 30, 2013

(65) Prior Publication Data

US 2014/0125751 A1 May 8, 2014

(30) Foreign Application Priority Data

Nov. 8, 2012 (JP) ..... 2012-246295

(51) Int. Cl.

| | |
|---|---|
| ***B41J 2/435*** | (2006.01) |
| ***B41J 2/47*** | (2006.01) |
| ***G03G 15/04*** | (2006.01) |
| ***G03G 15/043*** | (2006.01) |

(52) U.S. Cl.

CPC ..... *G03G 15/04072* (2013.01); *G03G 15/043* (2013.01)

(58) Field of Classification Search

USPC ..... 347/132, 133, 135, 224, 236, 237, 246, 347/247

See application file for complete search history.

(56) References Cited

U.S. PATENT DOCUMENTS

2011/0199657 A1 8/2011 Ishida et al.

FOREIGN PATENT DOCUMENTS

| | | | | |
|---|---|---|---|---|
| JP | 08-216451 A | | 8/1996 | |
| JP | 08216451 A | * | 8/1996 | ..... B41J 2/44 |
| JP | 2001-158130 A | | 6/2001 | |
| JP | 2002-067376 A | | 3/2002 | |
| JP | 2002-329924 A | | 11/2002 | |
| JP | 2011-167898 A | | 9/2011 | |

OTHER PUBLICATIONS

Japanese Notification of Reason(s) for Refusal dated Oct. 7, 2014 issued in the corresponding Japanese Patent Application No. 2012-246295 and English language translation (8 pages).

* cited by examiner

*Primary Examiner* — Hai C Pham

(74) *Attorney, Agent, or Firm* — Buchanan Ingersoll & Rooney PC

(57) ABSTRACT

An image forming apparatus for performing laser exposure is provided. The image forming apparatus includes a driving circuit for supplying drive current to a laser light source in accordance with an image pulse signal; a pulse width expansion portion for expanding a pulse width of the image pulse signal supplied to the driving circuit; and an adjustment control portion for setting, based on state data indicating a state related to light emission start characteristics of the laser light source, a value of the bias current supplied as a part of the drive current to the laser light source and an amount of expansion of the pulse width in such a manner that laser light emission occurs in a period of time having a length equal to a length of a pulse width of each pulse in the image pulse signal.

10 Claims, 18 Drawing Sheets

FIG. 5

551

| TEMPERATURE (°C) | OSCILLATION THRESHOLD CURRENT Ith(mA) | AMOUNT OF PULSE WIDTH REDUCTION T10(ns) |
|---|---|---|
| 10 | 5.1 | 6.5 |
| ⋮ | ⋮ | ⋮ |
| 25 | 10.1 | 6.6 |
| ⋮ | ⋮ | ⋮ |
| 60 | 20.1 | 6.7 |

FIG. 8

| TEMPERATURE | 10 ℃ | 25 ℃ | 60 ℃ |
|---|---|---|---|
| AMOUNT OF PULSE WIDTH REDUCTION T10 | 6.5 ns | 6.6 ns | 6.7 ns |
| OSCILLATION THRESHOLD CURRENT Ith | 5.1 mA | 10.1 mA | 20.1 mA |
| BIAS CURRENT VARIABLE RANGE | 0 – 5 mA | 0 – 10 mA | 0 – 20 mA |
| ADJUSTABLE RANGE BY BIAS CURRENT | 0 – 2.1 ns | 0 – 4.8 ns | 0 – 6 ns |
| STEP WIDTH IN PULSE WIDTH EXPANSION (UNIT AMOUNT OF EXPANSION) | 2 ns | 4 ns | 6 ns |
| AMOUNT OF EXPANSION T11 OF PULSE WIDTH (AMOUNT OF ROUGH ADJUSTMENT) | 6 ns | 4 ns | 6 ns |
| AMOUNT OF ADJUSTMENT T12 BY BIAS CURRENT (AMOUNT OF FINE ADJUSTMENT) | 0.5 ns | 2.6 ns | 0.7 ns |
| BIAS CURRENT VALUE Ib | 1.3 mA | 5.4 mA | 2.3 mA |
| SUM OF ADJUSTMENT AMOUNTS | 6.5 ns | 6.6 ns | 6.7 ns |

FIG. 11

552

| TEMPERATURE Temp (°C) | AGING ΔTa FOR OSCILLATION DELAY TIME (ns) | RISE TIME Tb FOR LIGHT EMISSION (ns) |
|---|---|---|
| ** | *** | *** |

FIG. 14

| TEMPERATURE | | 10 ℃ | 25 ℃ | 60 ℃ |
|---|---|---|---|---|
| TEMPERATURE CHARACTERISTICS DATA | AMOUNT OF PULSE WIDTH REDUCTION T10 | 6.3 ns | 6.4 ns | 6.5 ns |
| | OSCILLATION THRESHOLD CURRENT Ith | 5.0 mA | 10.0 mA | 20.0 mA |
| AGING MEASUREMENT DATA | AGING ΔTa FOR OSCILLATION DELAY TIME | 0.1 ns | | |
| | RISE TIME Tb' | 0.3 ns | | |
| AMOUNT OF PULSE WIDTH REDUCTION T10' IN EXPECTATION OF AGING | | 6.5 ns | 6.6 ns | 6.7 ns |
| MAXIMUM AMOUNT OF ADJUSTMENT BY BIAS CURRENT | | 2.1 ns | 4.8 ns | 6.0 ns |
| STEP WIDTH IN PULSE WIDTH EXPANSION (UNIT AMOUNT OF EXPANSION X) | | 1 ns | 1 ns | 1 ns |
| AMOUNT OF EXPANSION T11 OF PULSE WIDTH (AMOUNT OF ROUGH ADJUSTMENT) | | 6 ns | 7 ns | 7 ns |
| AMOUNT OF ADJUSTMENT T12 BY BIAS CURRENT (AMOUNT OF FINE ADJUSTMENT) | | 0.5 ns | −0.4 ns | −0.3 ns |
| BIAS CURRENT Ib | | 1.3 mA | 0 mA | 0 mA |
| SUM OF ADJUSTMENT AMOUNTS (T11+T12) | | 6.5 ns | 6.6 ns | 6.7 ns |

IMAGE FORMING APPARATUS THAT MATCHES LASER LIGHT EMISSION TIME TO PULSE WIDTH OF IMAGE PULSE SIGNAL

This application is based on Japanese patent application No. 2012-246295 filed on Nov. 8, 2012, the contents of which are hereby incorporated by reference.

BACKGROUND OF THE INVENTION

1. Field of the Invention

The present invention relates to an image forming apparatus for forming an image through laser exposure steps.

2. Description of the Related Art

An electrophotographic image forming apparatus forms an electrostatic latent image by applying laser light to a photoconductor uniformly charged. After that, toner is adhered to the electrostatic latent image to form a toner image, and the toner image thus formed is transferred onto a sheet of paper. In a laser exposure process during which the electrostatic latent image is formed, the laser light is emitted intermittently in accordance with image pulse signals depending on a dot pattern of the electrostatic latent image. At a time when a laser diode (LD) used as a laser light source is supplied with drive current greater than oscillation threshold current, the LD emits laser light. Therefore, in order to emit laser light intermittently, current control is so performed that the drive current is equal to or greater than the oscillation threshold current, or is smaller than the oscillation threshold current.

When the supply of drive current to the laser light source is started at an ON edge of a pulse for designating a light emission period in the image pulse signal, the start of laser light emission is delayed. This causes the laser light emission period to be shorter than the pulse width of the pulse of the image pulse signal. In short, pulse width reduction occurs. In order to perform laser exposure faithful to the image pulse signal, it is necessary to minimize the amount of pulse width reduction.

As for control over the amount of pulse width reduction, a technique is known in which bias current slightly smaller than oscillation threshold current is supplied to the laser light source, and thereby, the responsiveness of laser light emission is increased. An image forming apparatus is proposed which controls bias current in accordance with the result of detection of a luminous quantity in order to make the responsiveness constant independent of variation in responsiveness of the laser light source and of fluctuations in environmental temperature (Japanese Laid-open Patent Publication No. 2002-067376).

Another technique is disclosed for minimizing the amount of pulse width reduction. The technique is called "pulse width expansion" in which laser light emission is stopped after a predetermined lapse of time from an OFF edge of a pulse of the image pulse signal instead of stopping the laser light emission at an OFF edge of the pulse (Japanese Laid-open Patent Publication No. 2011-167898). According to the technique, laser light is emitted during a period of time corresponding to the pulse width of the expanded pulse at a time behind the pulse of the image pulse signal.

The amount of pulse width reduction corresponds to the sum of a time called an "oscillation delay time" and a time called a "rise time". The oscillation delay time is a period of time from when increasing drive current in the laser light source is started (ON edge of a pulse of the image pulse signal) to when laser light emission is started. The rise time is a period of time from when the laser light emission is started to when the amount of light emission reaches a predetermined amount of light necessary for exposure.

The oscillation delay time significantly varies depending on operating ambient temperature. For low operating ambient temperatures, the oscillation delay time is short. For high operating ambient temperatures, the oscillation delay time is long. The oscillation delay time and the rise time in the laser light source tend to be longer as time advances.

The conventional technique for minimizing the amount of pulse width reduction by bias current cannot eliminate the pulse width reduction by an amount corresponding to the rise time. When the operating ambient temperature is low, the oscillation threshold current is small. In that case, the adjustment range of the bias current is small, which makes it impossible to minimize the amount of pulse width reduction.

According to the other conventional technique for minimizing the amount of pulse width reduction by pulse width expansion, the amount of pulse width expansion cannot be set minutely due to limitation on resolution determined based on the clock of a control circuit. Increasing the clock frequency probably causes noise.

SUMMARY

The present disclosure has been achieved in light of such an issue, and therefore, an object of an embodiment of the present invention is to match a laser light emission time during which the amount of laser light necessary for exposure is emitted to the pulse width of an image pulse signal for designating a light emission period.

An image forming apparatus according to an aspect of the present invention is an image forming apparatus for performing laser exposure to form a latent image on a photoconductor. The image forming apparatus includes a laser light source; a driving circuit configured to supply drive current to the laser light source in accordance with an image pulse signal depending on a dot pattern of the latent image; a current adjustment portion configured to increase or decrease an amount of bias current, the bias current being supplied as a part of the drive current to the laser light source; a pulse width expansion portion configured to expand a pulse width of the image pulse signal supplied to the driving circuit; a state detection portion configured to obtain state data indicating a state related to light emission start characteristics of the laser light source; and an adjustment control portion configured to set, based on the state data, a value of the bias current and an amount of expansion of the pulse width in such a manner that laser light emission occurs in a period of time having a length equal to a length of a pulse width of each pulse in the image pulse signal.

These and other characteristics and objects of the present invention will become more apparent by the following descriptions of preferred embodiments with reference to drawings.

BRIEF DESCRIPTION OF THE DRAWINGS

FIG. 5 is a diagram showing an example of a temperature characteristics table.

FIG. 8 is a diagram showing a concrete example of light emission control to deal with pulse width reduction.

FIG. 11 is a diagram showing an example of data items of aging measurement data.

FIG. 14 is a diagram showing a concrete example of light emission control to deal with pulse width reduction.

DESCRIPTION OF THE PREFERRED EMBODIMENTS

Figure 1:
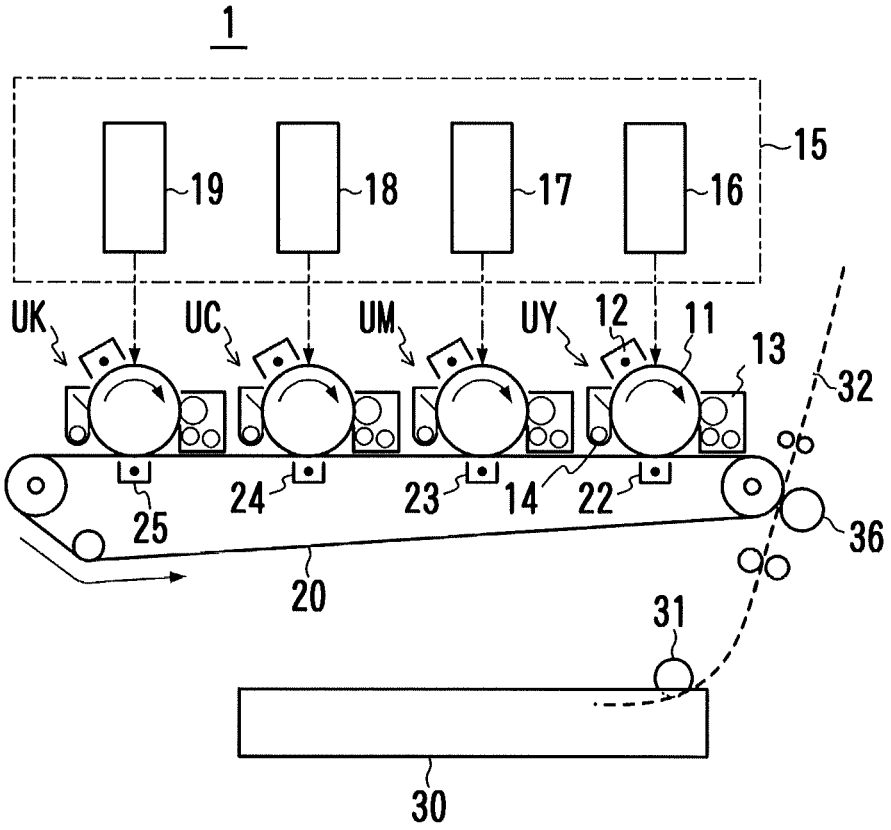
FIG. 1 is a diagram showing an example of the structure of the principal part of an image forming apparatus according to an embodiment of the present invention.

In this description, an image forming apparatus 1 shown in FIG. 1 is, for example, a Multi-functional Peripheral (MFP) for printing a color image by using electrophotography. The image forming apparatus 1 may be a printer, a copier, or a facsimile machine.

The image forming apparatus 1 is provided with four imaging stations UY, UM, UC, and UK for forming toner images for colors of yellow, magenta, cyan, and black respectively. The imaging station UY for forming a yellow toner image has a tubular photoconductor 11, an electrostatic charger 12, a developer unit 13, a cleaner 14, and so on. Each of the imaging stations UM, UC, and UK has the same structure as that of the imaging station UY except that the color of toner in the developer unit of the imaging station is different from that of the imaging station UY.

The imaging stations UY, UM, UC, and UK form the toner images for four colors sequentially. Transfer chargers 22, 23, 24, and 25 primarily transfer the toner images onto a transfer belt 20 in order. In parallel with this operation, a paper feed roller 31 sends non-illustrated paper from a sheet deck 30 to a paper path 32. A secondary transfer roller 36 secondarily transfers, onto a sheet of paper, the toner images for four colors overlaid through the primary transfer. A non-illustrated fixing unit on the paper path 32 applies heat and pressure to the paper, so that the toner images are fixed onto the paper.

The process for forming toner images include a latent image forming process in which the surface of the photoconductor uniformly charged is subjected to pattern exposure in accordance with image data. Referring to FIG. 1, the image forming apparatus 1 has a print head 15 for emitting an exposure beam for the latent image forming process. The print head 15 is provided above the imaging stations UY, UM, UC, and UK arranged horizontally. The print head 15 has laser scanners 16, 17, 18, and 19 corresponding to the imaging stations UY, UM, UC, and UK respectively. The laser scanners 16, 17, 18, and 19 have the same structures as each other. Accordingly, the structure of the laser scanner 16 is hereinafter described as a typical example of the structures of the laser scanners 16, 17, 18, and 19.

Figure 2A:
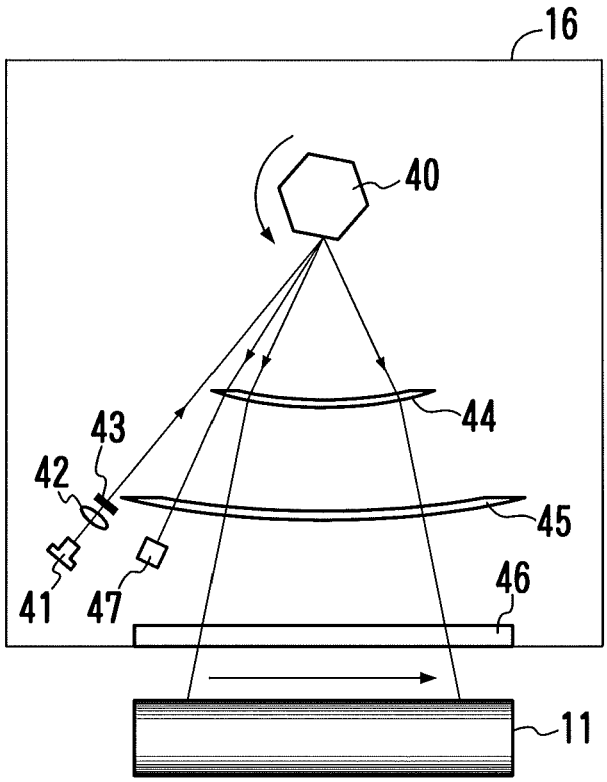
FIGS. 2A and 2B are diagrams showing an example of the structure of an optical system of a laser scanner.
Figure 2B:
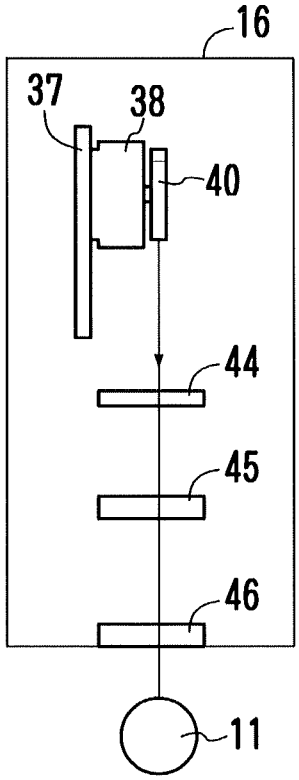

FIG. 2A shows an example of the overall structure of an optical system of the laser scanner 16. FIG. 2B shows an example of the positional relationship between a polygon motor 38 and the photoconductor 11. The up-down direction of FIGS. 2A and 2B corresponds to the vertical direction or the direction close thereto for a case where the laser scanner 16 is incorporated into the image forming apparatus 1 and is used therein.

As shown in FIG. 2A, the laser scanner 16 is provided with a polygon mirror 40, a laser light source 41, a collimator lens 42, a slit 43, scan lenses 44 and 45, a window 46, a Start of Scanning (SOS) sensor 47, and so on. As shown in FIG. 2B, the polygon motor 38 attached to a substrate 37 rotates the polygon mirror 40 above the photoconductor 11. A laser beam emitted from the laser light source 41 passes through the collimator lens 42, so that the laser beam turns to be a substantial parallel beam. The beam is in turn rectified by the slit 43 and the rectified beam enters the polygon mirror 40.

The laser beam reflected from the polygon mirror 40 passes through the scan lenses 44 and 45 and the window 46, and in turn, is applied to the photoconductor 11. The rotation of the polygon mirror 40 deflects the laser beam, so that a spot on the photoconductor 11 at which the laser beam is applied moves unidirectionally. The main scanning on the photoconductor 11 is performed by the output control over the laser light source 42 and the deflection of laser beam. Each of the scan lenses 44 and 45 has image forming characteristics with which the laser beam gathers on the surface of the photoconductor 11, and fθ characteristics with which the laser beam deflected at constant angular velocity by the polygon mirror 40 is moved along the main scanning direction at constant speed. The main scanning by the laser scanner 16 and the subscanning by rotation of the photoconductor 11 are performed, so that a two-dimensional electrostatic latent image is formed on the photoconductor 11. The SOS sensor 47 is an optical sensor disposed in an optical path of the deflected beam and beyond the main scanning area. The SOS sensor 47 is used to synchronize the output control over the laser light source 41 based on image data with the deflection of the laser beam.

Figure 3A:
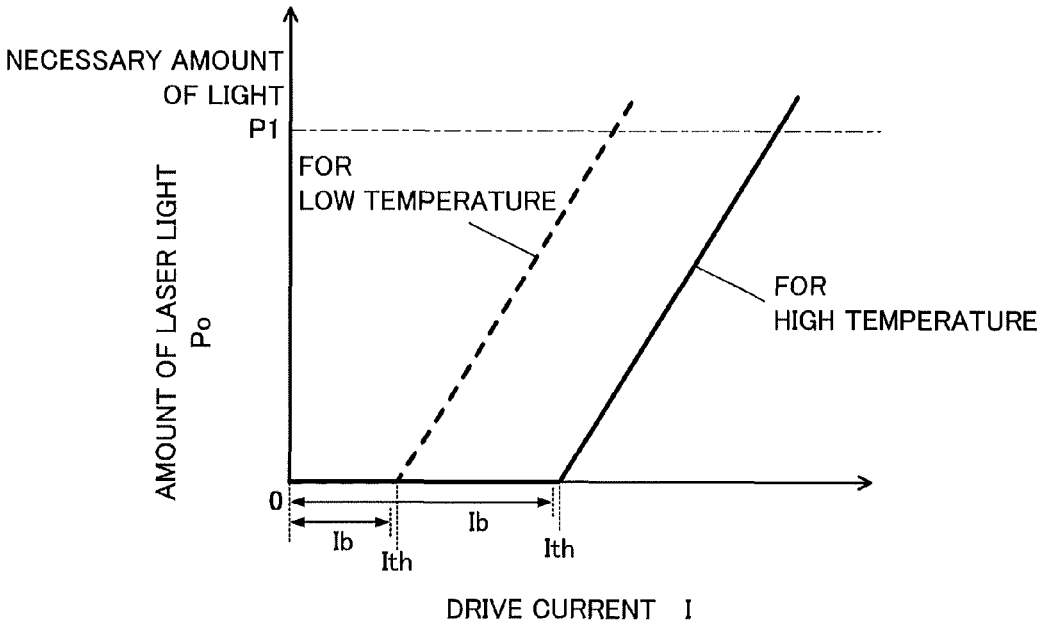
FIGS. 3A and 3B are diagrams showing light emission start characteristics of a laser light source.

FIG. 3A shows the relationship between drive current I supplied to the laser light source 41 and the amount of laser light Po. As shown in FIG. 3A, when the drive current I is smaller than oscillation threshold current Ith, the laser light source 41 emits no laser light. When the drive current I is equal to or greater than the oscillation threshold current Ith, the laser light source 41 emits laser light. Note that the amount of laser light Po for the case where the drive current I is equal to the oscillation threshold current Ith is smaller than necessary amount of light P1 for exposure of the photoconductor. In order to emit laser light having the necessary amount of light P1, the laser light source 41 should be supplied with the drive current I greater than the oscillation threshold current Ith.

The oscillation threshold current Ith varies depending on the operating ambient temperature of the laser light source 41. Within the temperature range in which the operation of the laser light source 41 is guaranteed, e.g., within the range between 10° C. and 60° C., the lower the temperature is, the smaller the oscillation threshold current Ith is. The responsiveness of laser light emission to light emission instructions can be improved by supplying, to the laser light source 41, bias current Ib having an amount corresponding to the oscillation threshold current Ith, which is dependent on the operating ambient temperature, as a part of the drive current I. The responsiveness increases to the maximum if the bias current Ib is set to be smaller than the oscillation threshold current Ith by an amount corresponding to a small margin in light of subtle variations in operating ambient temperature and disturbance.

Figure 3B:
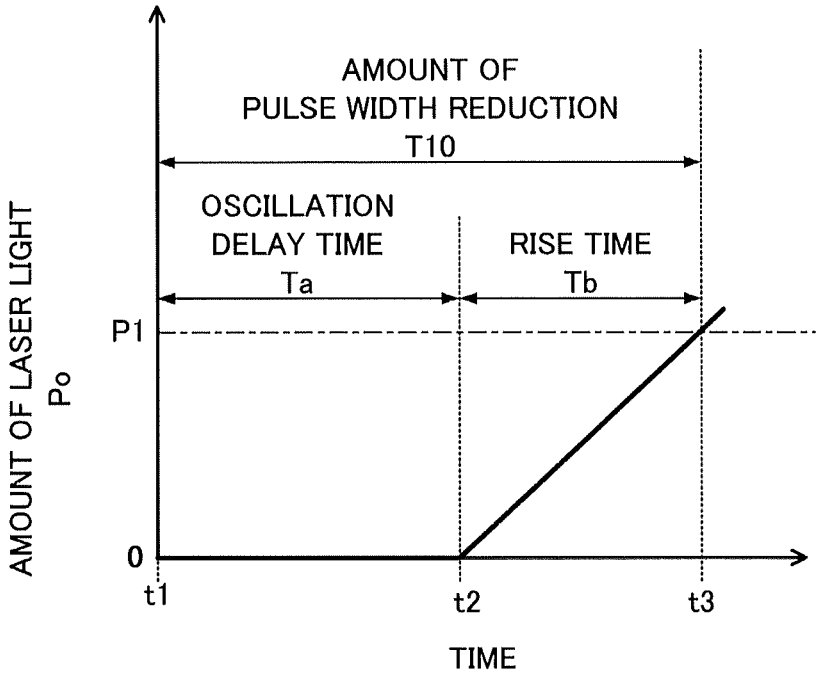

FIG. 3B shows the relationship between the amount of laser light Po and an elapsed time for the case where the drive current I is increased from zero with no bias current supplied. The oscillation delay time Ta is a period of time from a time point t1 at which increasing the drive current I is started to a time point t2 at which the drive current I turns to be the oscillation threshold current Ith and laser light emission starts. The rise time Tb is a period of time from the time point t2 to a time point t3 at which the amount of laser light Po reaches the necessary amount of light P1. The sum of the oscillation delay time Ta and the rise time Tb corresponds to the amount of pulse width reduction T10.

In the image forming apparatus 1, in order to reduce the amount of pulse width reduction T10 to zero, the bias current setting is so performed that the start of laser light emission is advanced, and pulse width expansion is so performed that the completion of laser light emission is delayed. The hardware configuration related to such light emission control is shown in FIG. 4.

First Example of Hardware Configuration

Figure 4:
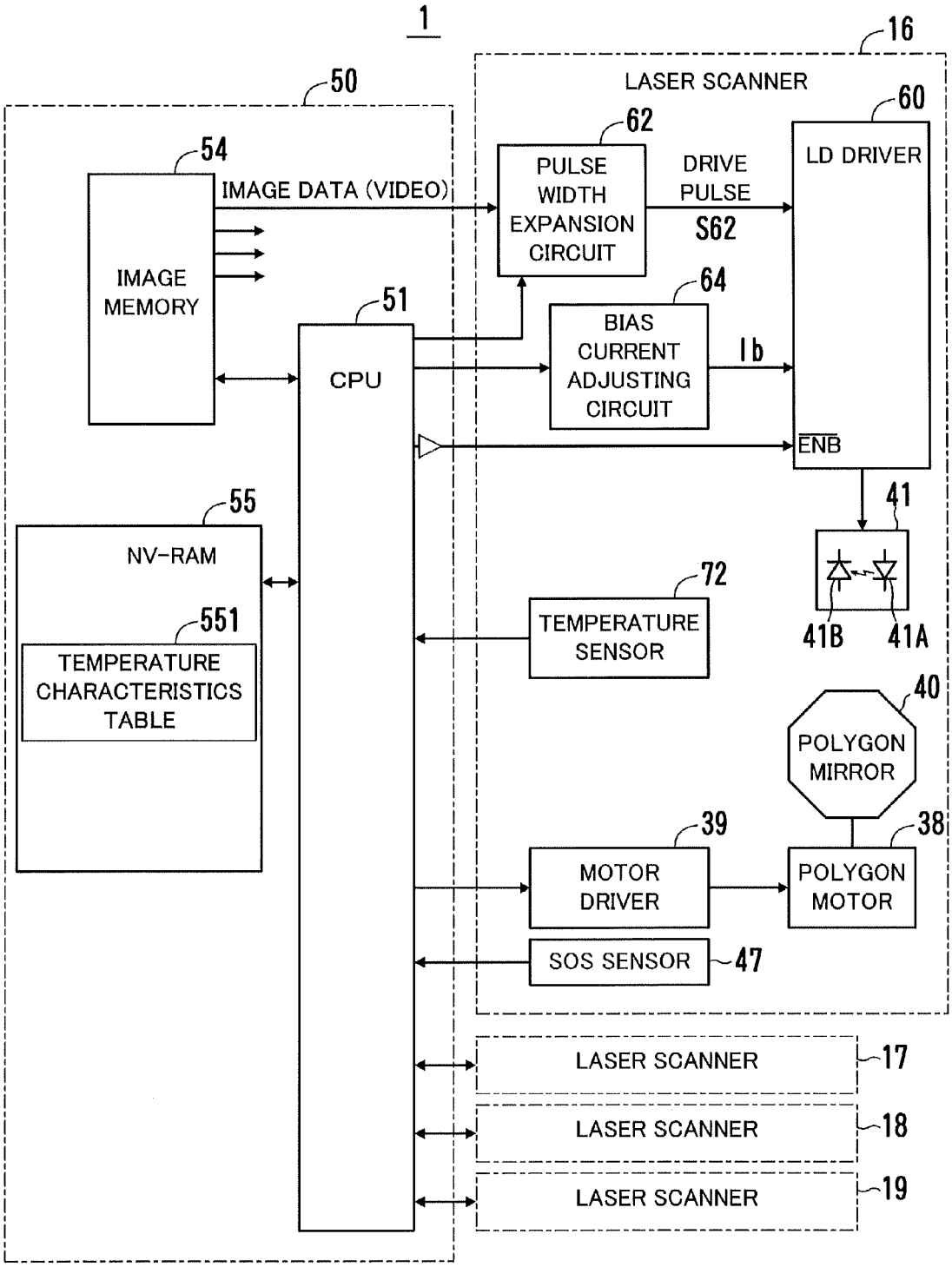
FIG. 4 is a diagram showing a first example of the hardware configuration related to control over laser light emission.

Referring to FIG. 4, the laser scanner 16 is provided with an LD driver 60 serving as a driving circuit of the laser light source 41, a pulse width expansion circuit 62, a bias current adjusting circuit 64, a temperature sensor 72 for making measurement of the operating ambient temperature of the laser light source 41, a motor driver 39 for driving the polygon motor 38, and so on.

The LD driver 60 controls, in accordance with a drive pulse signal S62 from the pulse width expansion circuit 62, the laser light source 41 to emit intermittently laser light from a laser diode (LD) 41A. At this time, the LD driver 60 feeds the bias current Ib supplied from the bias current adjusting circuit 64 to the laser diode 41A. During the light emission, the LD driver 60 adjusts, in accordance with the output from a photodiode 41B incorporated into the laser light source 41, drive current to be supplied to the laser diode 41A in such a manner that the amount of laser light Po is kept at the necessary amount of light P1.

The laser scanner 16 and laser scanners 17, 18, and 19 each of which is similar to the laser scanner 16 are controlled by a controller 50. The controller 50 has a Central Processing Unit (CPU) 51, an image memory 54, a nonvolatile memory 55, and so on.

The CPU 51 refers to a temperature characteristics table 551 stored in the nonvolatile memory 55. As shown in FIG. 5, the temperature characteristics table 551 indicates the oscillation threshold current Ith and the amount of pulse width reduction T10 for temperatures falling within the operation guarantee range, for example, in increments of 1° C. The CPU 51 obtains, from the temperature characteristics table 551, the oscillation threshold current Ith and the amount of pulse width reduction T10 corresponding to a temperature detected by the temperature sensor 72, and sets an amount of pulse width expansion and a value of bias current. The CPU 51 then instructs the pulse width expansion circuit 62 to expand the pulse width by the amount thus set, and instructs the bias current adjusting circuit 64 to supply the bias current having the value thus set. In accordance with the instructions, the pulse width expansion circuit 62 outputs a drive pulse signal S62 corresponding to image data VIDEO which is fed as an image pulse signal from the image memory 54, and the bias current adjusting circuit 64 outputs a bias current Ib.

The CPU 51 sends a horizontal synchronizing signal (HSYNC) and an image request signal (TOD) to the image memory 54. The TOD causes a subscanning counter (not shown) provided in the image memory 54 to start counting HSYNC. The image data VIDEO on a line depending on the count value is read out, and the image data VIDEO thus read out is sent to the pulse width expansion circuit 62.

Figure 6A:
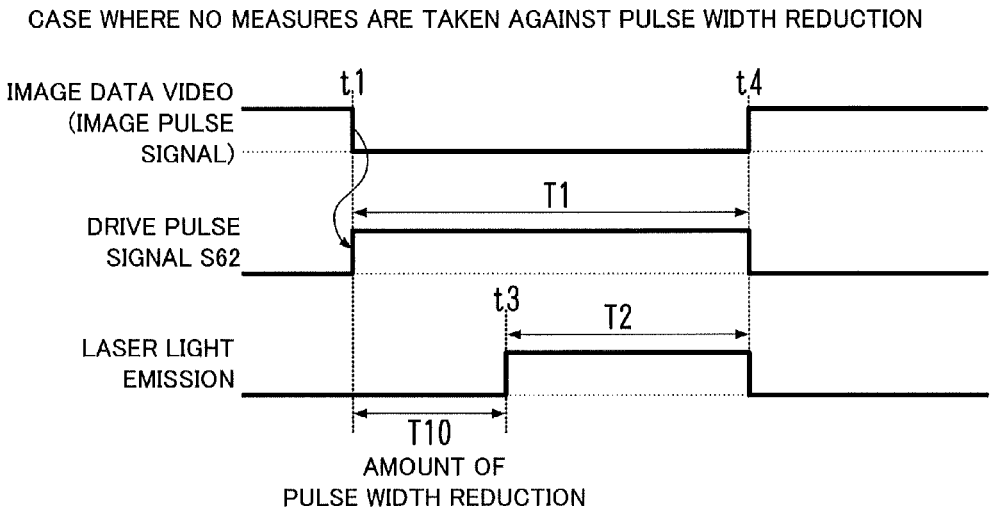
FIGS. 6A and 6B are timing charts showing correction to pulse width reduction.

FIG. 6A is a timing chart for laser light emission control for the case where no measures are taken against pulse width reduction. The drive pulse signal S62 becomes active at an ON edge (time point t1) of a pulse (low active in the illustrated example) for designating a light emission period in the image data VIDEO (image pulse signal). The drive pulse signal S62 becomes non-active at an OFF edge (time point t4) of the pulse in the image data VIDEO. Therefore, the length of a period T1 during which the drive pulse signal S62 is active is equal to the pulse width of the pulse of the image data VIDEO. However, the amount of laser light emission does not reach the necessary amount of light after a predetermined amount of time has elapsed since the drive pulse signal S62 became active and the drive current I started increasing. Stated differently, no laser light is emitted substantially from the time point t1 to the time point t3 at which the amount of laser light emission reaches the necessary amount of light. Thus, a period T2 during which effective laser light emission occurs is shorter than the period T1. The difference between the period T1 and the period T2 corresponds to the amount of pulse width reduction T10.

Figure 6B:
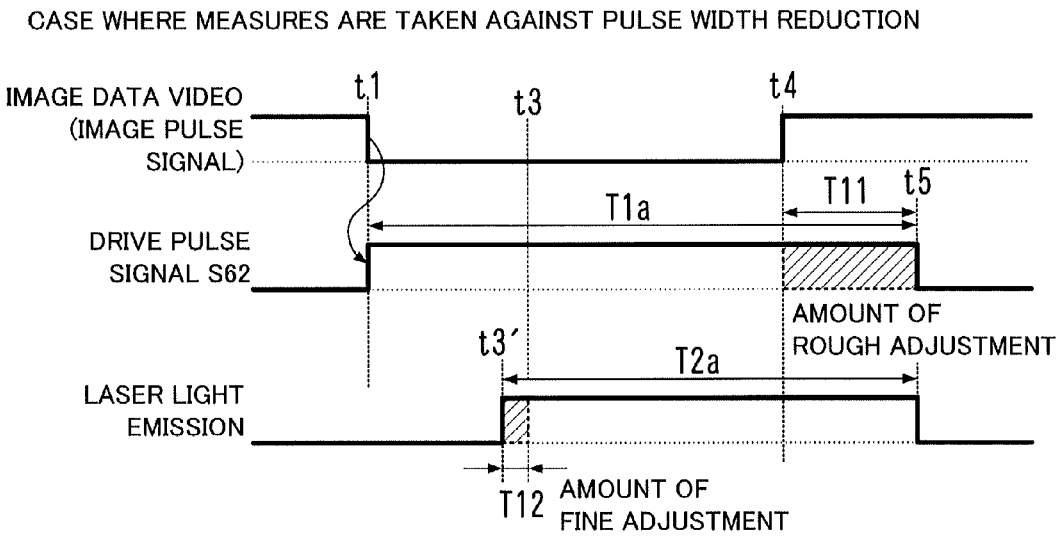

FIG. 6B is a timing chart for laser light emission control in the image forming apparatus 1 which takes measures against pulse width reduction. As with the case of FIG. 6A, the drive pulse signal S62 becomes active at an ON edge (time point t1) of the pulse in the image data VIDEO. However, unlike the case of FIG. 6A, the drive pulse signal S62 becomes non-active at a time point t5 posterior to the time point t4 corresponding to an OFF edge of the pulse in the image data VIDEO. Therefore, the length of a period T1a during which the drive pulse signal S62 is active is longer than the pulse width of the pulse in the image data VIDEO. A period between the time point t4 and the time point t5 corresponds to an amount of expansion T11 of pulse width. The amount of expansion T11 eventually corresponds to an amount of rough adjustment in the light emission control taken as the measures against the pulse width reduction.

Along with the rough adjustment by the pulse width expansion, fine adjustment by bias current is also performed. This causes effective laser light emission to start at a time point t3' prior to the time point t3. Passing the bias current shortens a period between the time point t1 at which increasing the drive current is started (the current value at the start point is the bias current value) and a time point at which laser light emission (oscillation) starts. Accordingly, the amount of laser light early reaches the necessary amount of light. A period T12 between the time point t3' and the time point t3 is so set that the difference between the amount of pulse width reduction T10 and the amount of expansion T11 of pulse width is compensated. The period T12 eventually corresponds to an amount of fine adjustment in the light emission control taken as the measures against the pulse width reduction.

Through the rough adjustment and the fine adjustment, the period T2a during which effective laser light emission occurs has a length equal to the pulse width of the pulse in the image data VIDEO. Thus, it is possible to realize laser exposure faithful to the dot pattern indicated in the image data VIDEO.

Figure 7:
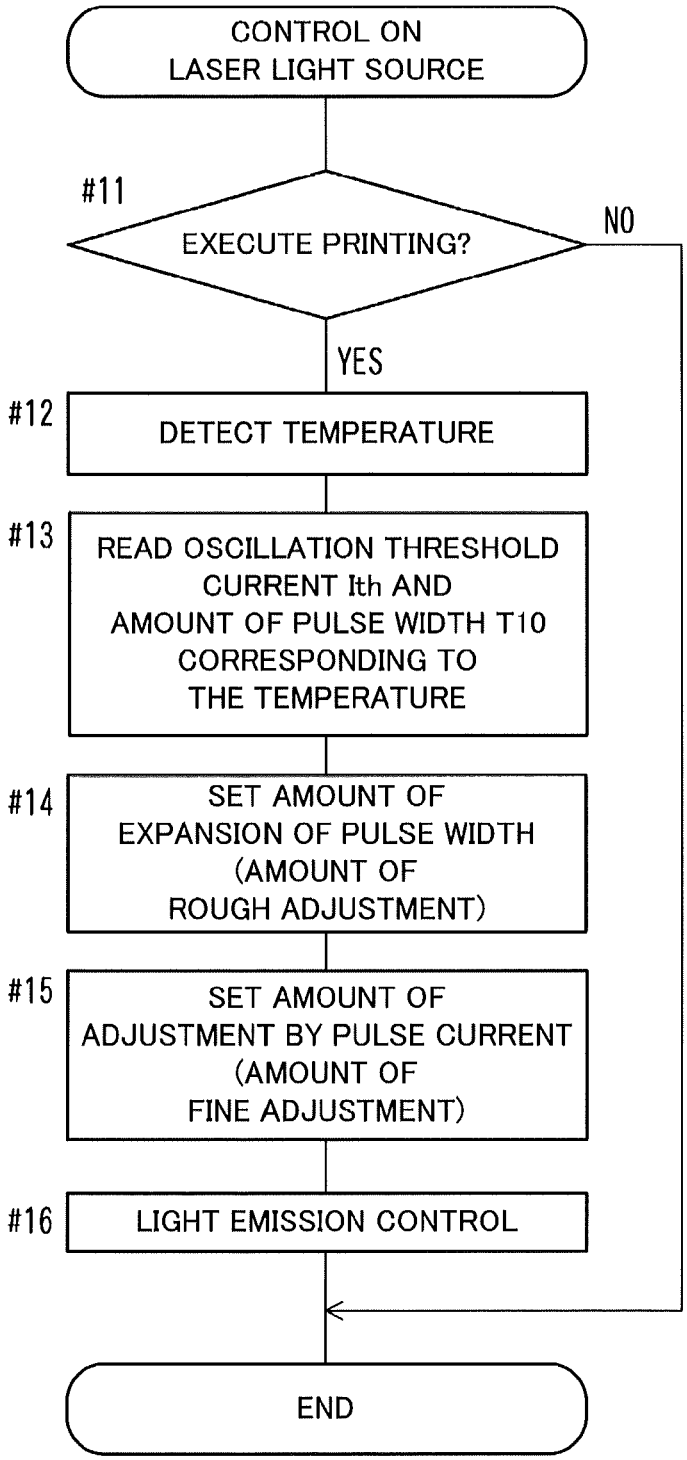
FIG. 7 is a flowchart depicting a first example of control on a laser light source.

FIG. 7 is a flowchart depicting an example of the outline of control on the laser light source by the CPU 51. The image forming apparatus 1 is given a copy job or a print job through direct operation using an operating panel thereof or through access from an external device via a network. When the image forming apparatus 1 is given a job to request print operation (Yes in Step #11), the CPU 51 executes the following processing.

The CPU 51 receives an output from the temperature sensor 72 to detect the operating ambient temperature of the laser light source 41 (Step #12). The CPU 51 reads a value of the oscillation threshold current Ith and an amount of pulse width reduction T10 corresponding to the temperature from the temperature characteristics table 551 (Step #13). At this time, if there is no temperature value matching the detected operating ambient temperature in temperature values listed in increments of 1° C., a temperature closest to the detected operating ambient temperature is selected. The CPU 51 sets an amount of expansion of pulse width to instruct the pulse width expansion circuit 62 to perform pulse width expansion (Step #14). The CPU 51 sets a value of bias current to instruct the bias current adjusting circuit 64 to supply bias current (Step #15). After finishing the series of preparation processing, the CPU 51 performs light emission control for printing (Step #16). In the light emission control, after a data processing means writes image data for exposure onto the image memory 54, the image memory 54 is controlled to output image data VIDEO and the laser scanner 16 is controlled to emit laser light.

FIG. 8 shows a concrete example of light emission control to deal with pulse width reduction. To be specific, FIG. 8 shows an example of the amount of expansion of pulse width (amount of rough adjustment) and the amount of adjustment by bias current (amount of fine adjustment) for the case where the operating ambient temperature detected by the temperature sensor 72 is 10° C., 25° C., or 60° C.

In the example, when the operating ambient temperature is detected to be 10° C., the amount of pulse width reduction T10 read from the temperature characteristics table 551 is 6.5 ns, and the oscillation threshold current Ith read therefrom is 5.1 mA. Suppose that the oscillation threshold current Ith has a subtle variation of 0.1 mA. In such a case, the bias current variable range includes values equal to or smaller than 5 mA that is smaller than the oscillation threshold current Ith by 0.1 mA, i.e., includes values from 0 mA to 5 mA.

The CPU 51 finds, based on non-illustrated data indicating transient characteristics for supply of the drive current I to the laser light source 41, an adjustable range obtained by converting the bias current variable range to time. In the example of FIG. 8, the adjustable range includes values between 0 ns and 2.1 ns. Smaller bias current is better in order to reduce unnecessary light emission (so-called LED light emission) that is not the laser light emission. The CPU 51 therefore determines a step width (unit amount of expansion) in the pulse width expansion in a manner to obtain a larger amount of expansion of the pulse width with adjustment margin by bias current being kept. To be specific, the CPU 51 sets the step width at 2 mA that is a value obtained by subtracting, from the upper limit value of the adjustable range by bias current, namely, 2.1 ns, the number after the decimal point. If the upper limit value is a decimal fraction, the step width is 0 (zero) ns, which means not performing the pulse width expansion. The step width corresponds to an amount of delay of each delay of a delay array used to delay the OFF edge of the pulse in the pulse width expansion circuit 62.

The CPU 51 sets, as the amount of expansion T11 of pulse width, a period of time that has a length of "m" times longer than the step width where "m" is an integer equal to or greater than "1", and at the same time, has a greatest length among values smaller than the pulse width reduction T10 of 6.5 ns. The amount of expansion T11 for the detected temperature of 10° C. is 6 ns that is three times longer than the step width. The determination of the amount of expansion T11 leads to the determination of the amount of adjustment T12 by bias current. The difference between the amount of pulse width reduction T10 and the amount of expansion T11 corresponds to the amount of adjustment T12. Referring to FIG. 8, the amount of adjustment T12 for a temperature of 10° C. is 0.5 ns. The CPU 51 sets, based on the foregoing data indicating transient characteristics (not illustrated), a bias current value Ib to promote the start of laser light emission by 0.5 ns corresponding to the amount of adjustment T12. In the example of FIG. 8, the bias current value Ib for a temperature of 10° C. is set at 1.3 mA.

Likewise, the CPU 51 sets the amount of expansion T11 of pulse width and the bias current value Ib depending on the operating ambient temperature. For the case of a temperature of 25° C., the upper limit value of the adjustable range by bias current is 4.8 ns, and the step width in pulse width expansion is set at 4 ns. In short, a delay having a delay amount of 4 ns is used in the pulse width expansion circuit 62. The amount of expansion T11 of pulse width is set at 4 ns that is one time as the step width. The amount of adjustment T12 by bias current is 2.6 ns that is obtained by subtracting the amount of expansion T11 of 4 ns from the amount of pulse width reduction T10 of 6.6 ns. The bias current value Ib is set at 5.4 mA. For the case of a temperature of 60° C., the step width in pulse width expansion is set at 6 ns, and the amount of expansion T11 of pulse width is set at 6 ns that is one time as the step width. The amount of adjustment T12 by bias current is 0.7 ns, and the bias current value Ib is set at 2.3 mA.

Second Example of Hardware Configuration

Figure 9:
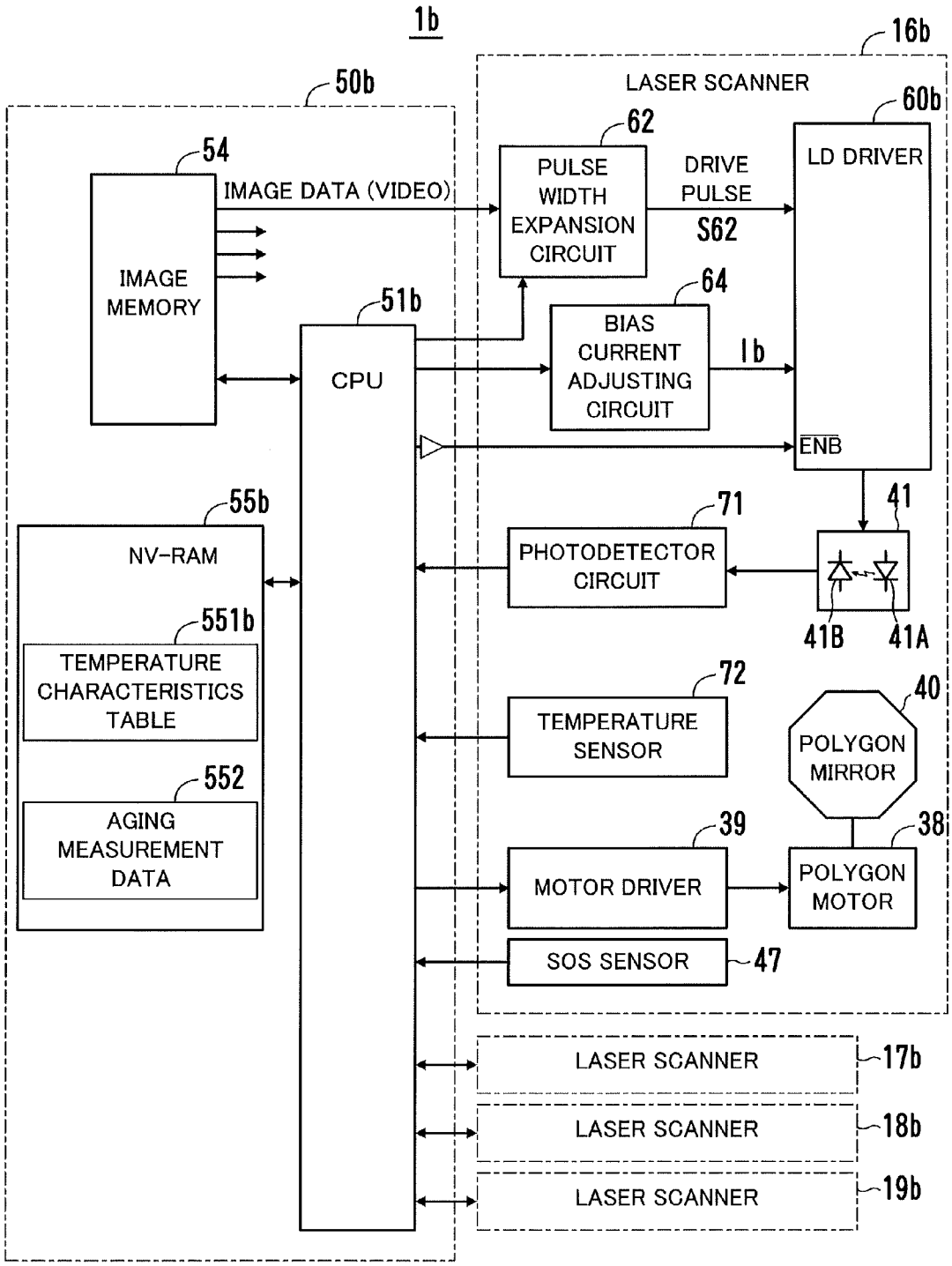
FIG. 9 is a diagram showing a second example of the hardware configuration related to control over laser light emission.

FIG. 9 is a diagram showing a second example of the hardware configuration related to control over laser light emission. The configuration of an image forming apparatus 1*b* according to the second example is basically the same as that of the image forming apparatus 1 according to the first example. The image forming apparatus 1*b* in the second example includes laser scanners 16*b*, 17*b*, 18*b*, and 19*b* in place of the laser scanners 16, 17, 18, and 19 of the first example, and a controller 50*b* in place of the controller 50 of the first example.

Referring to FIG. 9, the laser scanner 16*b* is provided with the configuration of the laser scanner 16 of the first example, and also provided with a photodetector circuit 71 for detecting aging in light emission start characteristics of the laser light source 41*b*. The photodetector circuit 71 sends, to the controller 50*b*, detection data indicating whether or not laser light is emitted from a laser diode 41Ab and indicating the amount of laser light based on an output from the photodiode 41B of the laser light source 41*b*.

A CPU 51*b* of the controller 50*b* gives instructions to the LD driver 60*b* at a preset time to cause the laser light source 41*b* to emit light. The CPU 51*b* then obtains data indicating aging in light emission start characteristics of the laser light source 41. To be more specific, the CPU 51*b* gradually increases drive current I supplied to the laser light source 41*b*, and obtains a value of the oscillation threshold current Ith and a value of the drive current I which makes the amount of laser light Po reach the necessary amount of light P1 based on detection data from the photodetector circuit 71. The CPU 51*b* then generates aging measurement data 552 described later, and stores the same into a non-volatile memory 55*b*. The aging measurement data 552 is used, at the time of light emission control for printing, to correct control operation based on a temperature characteristics table 551*b*.

Figure 10A:
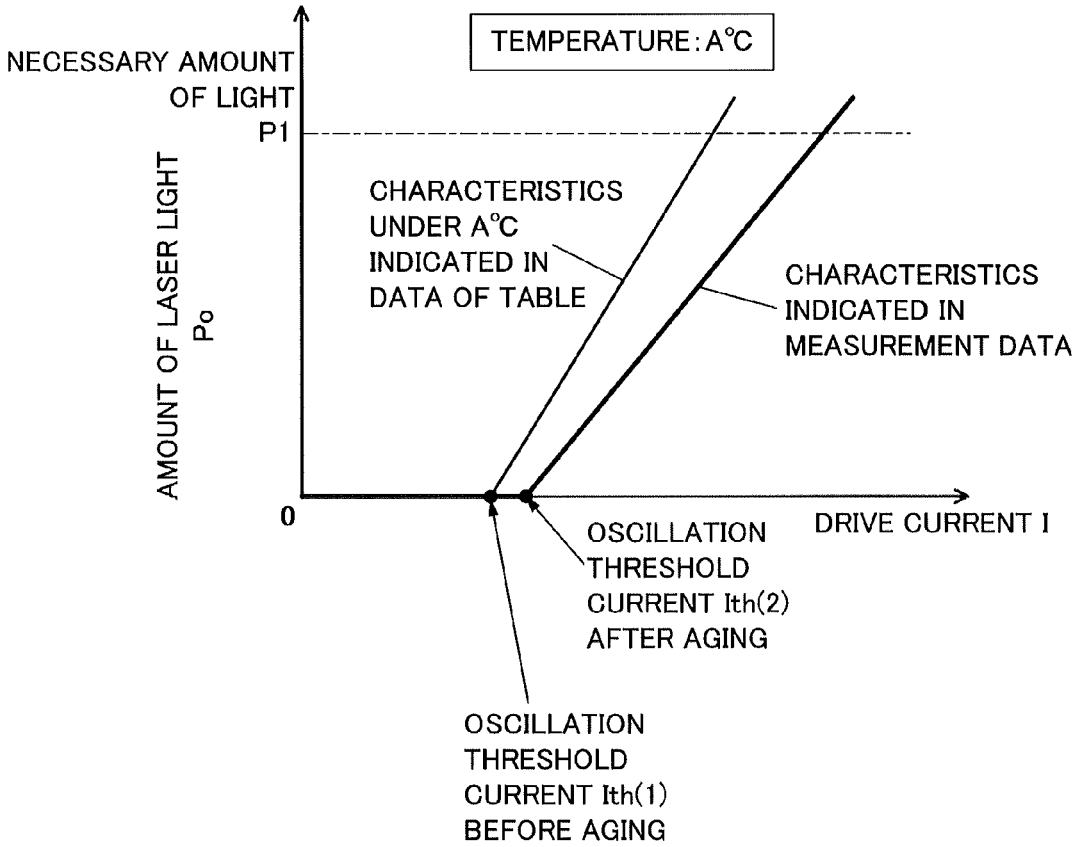
FIGS. 10A and 10B are diagrams showing an example of aging in light emission start characteristics.
Figure 10B:
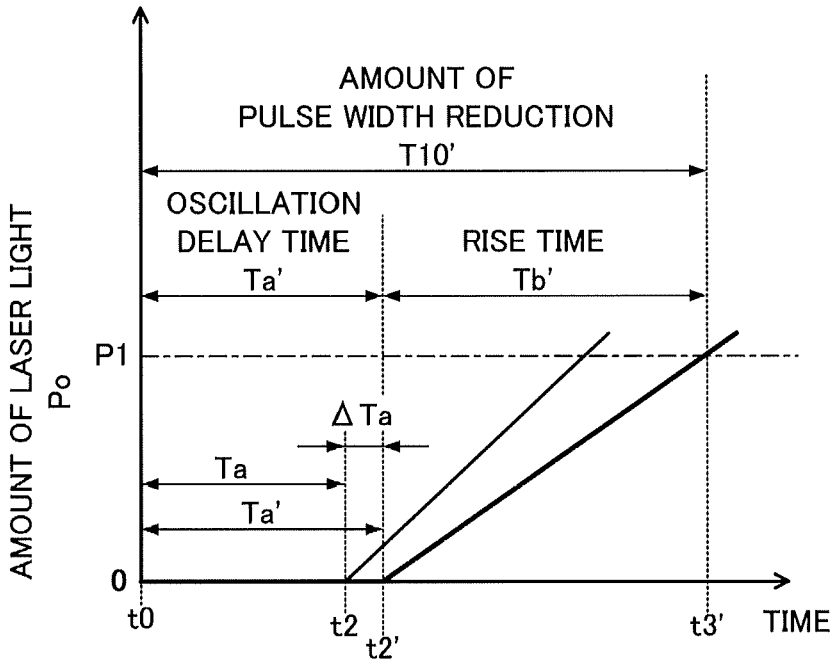

FIGS. 10A and 10B show an example of aging in light emission start characteristics. In FIG. 10A, the operating ambient temperature is denoted by "A"° C., and, for the sake of convenience, the oscillation threshold current Ith corresponding to "A"° C. shown in the temperature characteristics table 551*b* is denoted by Ith(1). The oscillation threshold current Ith(1) shows a value before aging. With years of the use of the image forming apparatus 1*b*, aging occurs in which the oscillation threshold current Ith increases. The post-aging oscillation threshold current Ith is denoted by Ith(2) for the sake of convenience. As known from FIG. 10A, as the aging, increase in amount of light after the start of laser light emission becomes slow.

For detection of aging, the drive current I is gradually increased with time measured, and oscillation delay time Ta' and an amount of pulse width reduction T10' shown in FIG. 10B are measured. The oscillation delay time Ta' is time required for the laser light emission to start for a case where the drive current I is increased from zero. To be specific, the oscillation delay time Ta' corresponds to a period of time from the time point t0 to the time point t2'. The amount of pulse width reduction T10' corresponds to a period of time required for the amount of laser light Po to reach the necessary amount of light P1, namely, a period of time from the time point t0 to the time point t3' in FIG. 10B.

The operation of subtracting the oscillation delay time Ta' from the amount of pulse width reduction T10' is performed, so that rise time Tb' for the operating ambient temperature (A° C.) under which the measurement was made is found. It is also possible to obtain the difference between the oscillation delay time Ta' thus measured and the oscillation delay time Ta specified based on the data for A° C. in the temperature characteristics table 551, namely, to find aging ΔTa for oscillation delay time. As shown in FIG. 11, the rise time Tb' found and the aging ΔTa for oscillation delay time are stored, as aging measurement data 552, together with the temperature at the time of the measurement.

A predetermined relationship is established between the aging ΔTa for oscillation delay time and the temperature. Therefore, even when a temperature at the time of detection of the aging and a temperature at the time of printing are different from each other, it is possible to calculate the aging ΔTa for oscillation delay time at the time of printing. Accordingly, when the adjustable range by bias current is specified at the time of printing, correction of adding the aging ΔTa may be made to the adjustable range defined based on data of the temperature characteristics data 551. In the case where the aging ΔTa for oscillation delay time hardly depends on the temperature, correction of adding the aging ΔTa stored in the form of aging measurement data 552 may be made.

In this embodiment, the rise time Tb' does not depend on temperature substantially. Accordingly, the amount of pulse width reduction T10 is determined by adding the rise time Tb' stored in the form of aging measurement data 552 to the oscillation delay time Ta that has been corrected so as to correspond to the temperature at the time of printing.

Figure 12:
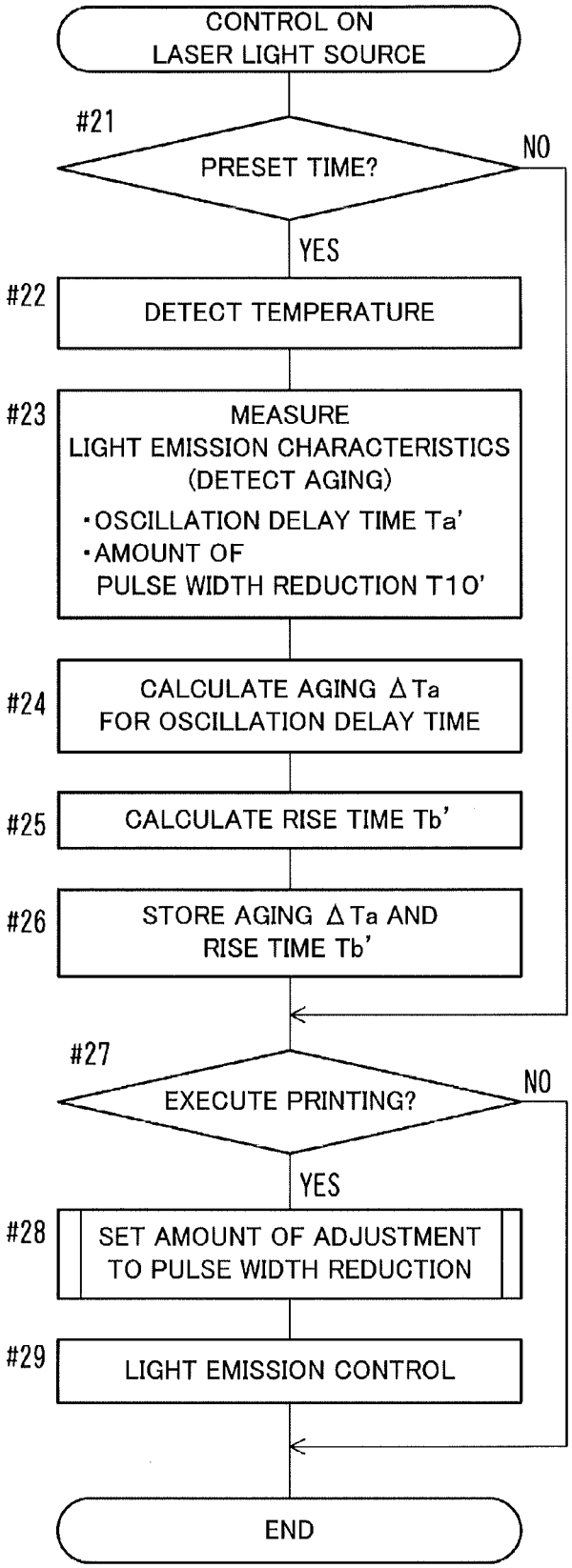
FIG. 12 is a flowchart depicting a second example of control on a laser light source.

FIG. 12 is a flowchart depicting a second example of control over a laser light source. The CPU 51*b* detects aging in light emission start characteristics of the laser light source 41 at a preset time. Examples of the preset time are a time at which the accumulated used time of the image forming apparatus 1*b* reaches a set value, a time at which the accumulated used sheets for printing in the image forming apparatus 1*b* reaches a set value, and a time at which the operating ambient temperature changes abruptly. First, the CPU 51*b* detects the operating ambient temperature of the laser light source 41 (Step #22), controls the laser light source 41 to emit light, and measures the oscillation delay time Ta' and the amount of pulse width reduction T10' (Step #23). Subsequently, the CPU 51*b* calculates the aging ΔTa for oscillation delay time (Step #24), and calculates the rise time Tb' (Step #25). The CPU 51*b* then stores the aging ΔTa and the rise time Tb' into the memory 55*b* as the aging measurement data 552 (Step #26).

When the image forming apparatus 1*b* performs printing (Yes in Step #27), the CPU 51*b* executes processing for setting the amount of adjustment to pulse width reduction (Step #28), and after that, executes the light emission control processing (Step #29).

Figure 13:
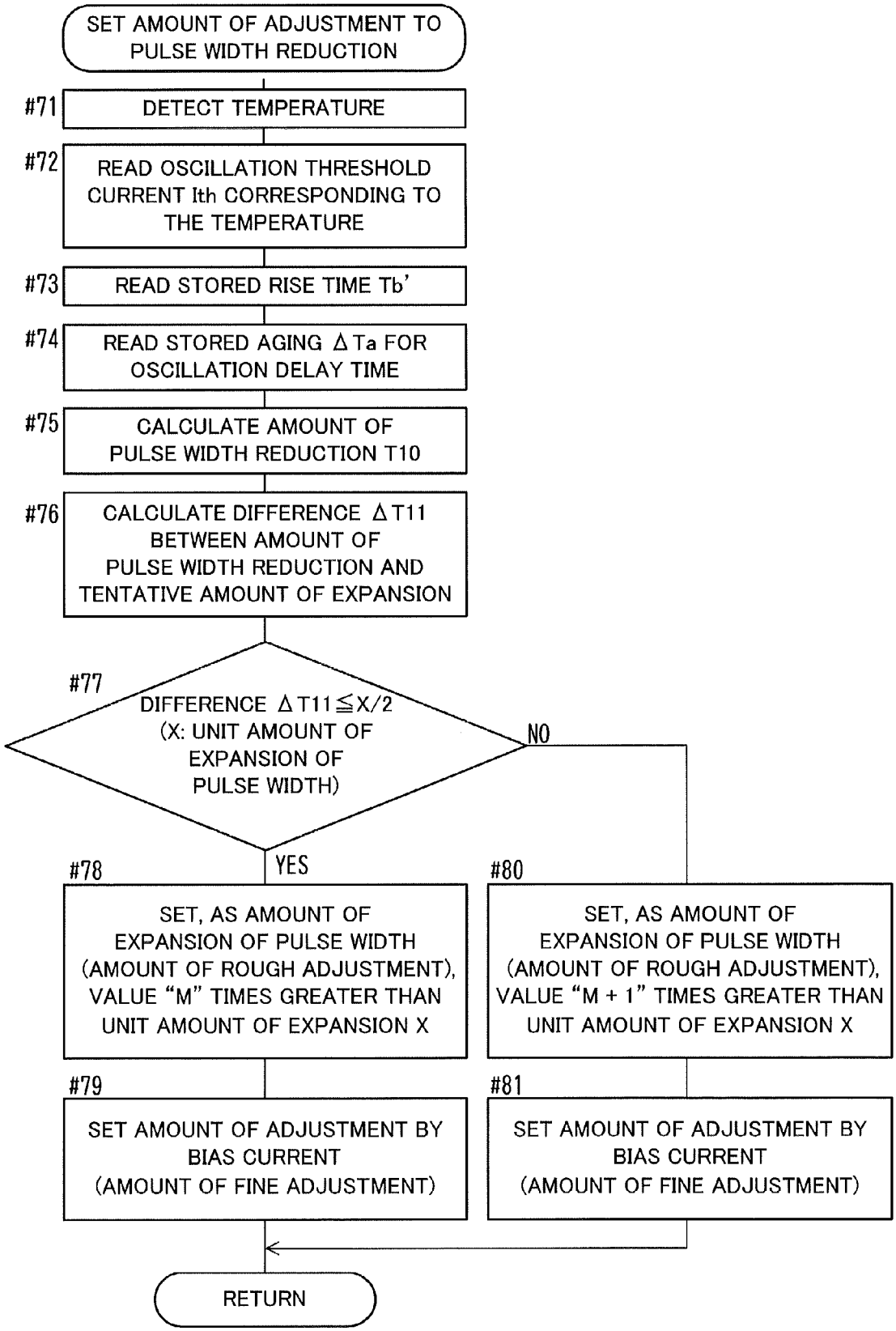
FIG. 13 is a flowchart depicting an example of a routine for setting the amount of adjustment to deal with pulse width reduction.

FIG. 13 is a flowchart depicting an example of a routine for setting the amount of adjustment to deal with the pulse width reduction. The CPU 51*b* receives an output from the temperature sensor 72 to detect the operating ambient temperature of the laser light source 41 (Step #71). The CPU 51*b* then reads, from the temperature characteristics table 551, a value of the oscillation threshold current Ith corresponding to the current operating ambient temperature (Step #72), and reads the rise time Tb' and the aging ΔTa for oscillation delay time that are the aging measurement data 552 (Step #73 and Step #74).

The CPU 51*b* then calculates the amount of pulse width reduction T10 (Step #75) to calculate the difference (ΔT11) between the amount of pulse width reduction T10 and a tentative amount of expansion of pulse width (Step #76). The tentative amount of expansion corresponds to a period of time that has a length of "m" times longer than a unit amount of expansion X, and at the same time, has a greatest length among values smaller than the pulse width reduction T10.

The CPU 51*b* compares the difference ΔT11 with a half of the unit amount of expansion X (Step #77), and, depending on the result of comparison, sets the amount of rough adjustment and the amount of fine adjustment. In this example, the maximum amount of rough adjustment is so set that bias current which causes unnecessary light emission is reduced to the minimum.

If the difference ΔT11 is equal to or smaller than a half of the unit amount of expansion X (Yes in Step #77), then the CPU 51*b* sets, as the amount of expansion T11 of pulse width (amount of rough adjustment), a time having a length of "m" times greater than the unit amount of expansion X which is used as the tentative amount of expansion (Step #78). The CPU 51*b* then sets the amount of adjustment T12 by bias current to compensate the difference between the amount of pulse width reduction T10 and the amount of expansion T11 (Step #79).

On the other hand, if the difference ΔT11 is greater than a half of the unit amount of expansion X (No in Step #77), then the CPU 51*b* sets, as the amount of expansion T11 of pulse width (amount of rough adjustment), a time having a length of (m+1) times longer than the unit amount of expansion X (Step #80). The amount of adjustment T12 by bias current is so set to compensate the difference between the amount of pulse width reduction T10 and the amount of expansion T11 (Step #81). In such a case, only the rough adjustment causes the period T2a during which laser light emission occurs as shown in FIG. 6B to be longer than a period of time during which the image data VIDEO is active (period of time from t1 to t4) by a length corresponding to the half of the unit amount of expansion X or shorter. Therefore, in the fine adjustment (correction by bias current), laser light emission starts after the time point t3 rather than before the same. In other words, the start of laser light emission is somewhat delayed intentionally. In order to delay the start of laser light emission, for example, a circuit constant of a circuit to which the drive current I is supplied is changed to increase the oscillation delay time.

FIG. 14 shows a concrete example of correcting pulse width reduction in light of aging of the laser light source. FIG. 14 shows an example of the amount of expansion of pulse width (amount of rough adjustment) and the amount of adjustment by bias current (amount of fine adjustment) for the case where the operating ambient temperature detected by the temperature sensor 72 is 10° C., 25° C., or 60° C.

In the example, when the operating ambient temperature is detected to be 10° C., the amount of pulse width reduction T10 read from the temperature characteristics table 551*b* is 6.3 ns, and the oscillation threshold current Ith read therefrom is 5.0 mA. Suppose that the aging ΔTa for oscillation delay time stored as the aging measurement data 552 is 0.1 ns, and the rise time Tb' is 0.3 ns. In this example, it is supposed that both the aging ΔTa and the rise time Tb' have constant values irrespective of temperature.

For the case of 10° C., the amount of pulse width reduction T10' in expectation of aging after the correction based on the aging measurement data 552 is 6.5 ns, and the maximum amount of adjustment by bias current is 2.1 ns. The step width (unit amount of expansion X) in the pulse width expansion corresponds to a period of time having the shortest length in the structure of the pulse width expansion circuit 62 (resolution). The step width is, for example, 1 ns.

The amount of pulse width reduction T10' to be corrected is 6.5 ns, and therefore, the tentative amount of expansion is regarded as 6 ns that is a value corresponding to 6 times longer than the unit amount of expansion X (i.e., m=6). The difference ΔT11 between the amount of pulse width reduction T10' and the tentative amount of expansion is equal to or smaller than 0.5 ns that is a half of the unit amount of expansion X. Accordingly, in such a case, the tentative amount of expansion is set as the amount of expansion T11 of pulse width. The pulse width expansion circuit 62 uses, for example, a delay array in which six delays having a delay amount of 1 ns are connected to one another to expand the pulse width by the preset amount of expansion T11.

The determination of the amount of expansion T11 leads to the determination of the amount of adjustment T12 by bias current. The difference between the amount of pulse width reduction T10' and the amount of expansion T11 corresponds to the amount of adjustment T12. Referring to FIG. 14, the amount of adjustment T12 for a temperature of 10° C. is 0.5 ns. The CPU 51 sets a bias current value Ib to promote the start of laser light emission by 0.5 ns corresponding to the amount of adjustment T12. In the example of FIG. 14, the bias current value Ib for a temperature of 10° C. is set at 1.3 mA.

In the example, when the operating ambient temperature is 25° C., the amount of pulse width reduction T10 read from the temperature characteristics table 551*b* is 6.4 ns, and the oscillation threshold current Ith read therefrom is 10.0 mA. The amount of pulse width reduction T10' in expectation of aging is 6.6 ns, and the maximum amount of adjustment of correction by bias current is 4.8 ns. The unit amount of expansion X is 1 ns.

As with the case of 10° C., the tentative amount of expansion for 25° C. is also regarded as 6 ns. The difference ΔT11 between the amount of pulse width reduction T10' and the tentative amount of expansion, namely, 0.6 ns, is a period of time longer than 0.5 ns which corresponds to a half of the unit amount of expansion X. Therefore, in such a case, a value obtained by adding one unit amount of expansion X to the tentative amount of expansion, namely, 7 ns, is set as the amount of expansion T11 of pulse width. The amount of expansion T11 is a value which is (m+1) times greater than the unit amount of expansion X.

The determination of the amount of expansion T11 leads to the determination of the amount of adjustment T12 by bias current. The difference between the amount of pulse width reduction T10' and the amount of expansion T11 corresponds to the amount of adjustment T12. Referring to FIG. 14, the amount of adjustment T12 for a temperature of 25° C. is −0.4 ns. The amount of adjustment T12 is, in this case, a negative number. This means that laser light emission is started later than that of the case where the bias current Ib is set at zero. The CPU 51 sets the bias current value Ib at zero mA and controls the LD driver 60*b* to reduce a current increase ratio for the case where the drive current I is supplied, so that the start of laser light emission is delayed.

In the example, when the operating ambient temperature is 60° C., the tentative amount of expansion is regarded as 6 ns, and the difference ΔT11 between the amount of pulse width reduction T10' and the tentative amount of expansion is 0.7 ns. Since the difference ΔT11 is greater than a half of the unit amount of expansion X, the amount of expansion T11 is set at 7 ns. The amount of adjustment T12 by bias current is −0.3 ns. The CPU 51 sets the bias current value Ib at zero mA, and controls the LD driver 60*b* to reduce a current increase ratio of drive current I.

According to the second example, even when measurable aging occurs in the light emission start characteristics of the laser diode 41Ab of the laser light source 44*b*, laser exposure can be performed in accordance with a pattern designated in the image data VIDEO. The aging is detected at a preset time only. Accordingly, in comparison with detection of aging for each print process, the number of times of forced light emission for the detection is reduced, so that aging of the laser light source 41*b* is reduced. Instead of this, however, it is possible to detect aging for each print process, and to perform light emission control depending on the actual state of the laser light source 41*b*.

In the embodiment discussed above, the temperature characteristics table 551 may be provided in the form of look-up table indicating set values of amount of expansion T11 of pulse width and bias current Ib found in advance for each value of temperatures. In such a case, the set values corresponding to a detected operating ambient temperature may be used for control on the laser scanner 16. When the temperature characteristics table 551 has no data on temperature corresponding to the temperature detected by the temperature sensor 72, it is possible to obtain necessary data by performing interpolation operation based on data on temperature close to the detected temperature.

Examples of state data indicating states related to light emission characteristics of the laser light sources 41 and 41*b* are a count value indicating the use history such as the operating time of the laser light source 41 or 41*b*, the operating time of the image forming apparatus 1 or 1*b*, and the number of prints by the image forming apparatus 1 or 1*b*. In short, it is possible to set the amount of adjustment of light emission control to deal with the pulse width reduction by estimating the current light emission characteristics based on the use history.

In the foregoing embodiment, the configurations of the image forming apparatuses 1 and 1*b* may be modified appropriately within the scope of the present invention. For example, the function of the pulse width expansion circuit 62 for delaying an OFF edge of a pulse by using delay devices may be implemented by software processing.

According to the foregoing embodiments, depending on a state of the laser light source, pulse width expansion is performed to delay the end of laser light emission and bias current adjustment is performed to change the start time of laser light emission. This makes it possible to correctly match a laser light emission time during which the amount of laser light necessary for forming a latent image onto the photoconductor is emitted to the pulse width of an image pulse signal for designating a light emission period.

While example embodiments of the present invention have been shown and described, it will be understood that the present invention is not limited thereto, and that various changes and modifications may be made by those skilled in the art without departing from the scope of the invention as set forth in the appended claims and their equivalents.

What is claimed is:

1. An image forming apparatus for performing laser exposure to form a latent image on a photoconductor, the image forming apparatus comprising:

a laser light source;

a driving circuit configured to supply drive current to the laser light source in accordance with an image pulse signal depending on a dot pattern of the latent image;

a current adjustment portion configured to increase or decrease an amount of bias current, the bias current being supplied as a part of the drive current to the laser light source;

a pulse width expansion portion configured to expand a pulse width of the image pulse signal supplied to the driving circuit;

a state detection portion configured to obtain state data indicating a state related to light emission start characteristics of the laser light source; and an adjustment control portion configured to set, based on the state data, a value of the bias current and an amount of expansion of the pulse width in such a manner that laser light emission occurs in a period of time having a length equal to a length of a pulse width of each pulse in the image pulse signal, wherein the adjustment control portion sets the value of the bias current and the amount of expansion of the pulse width in such a manner that the amount of expansion of the pulse width is greater than an amount of adjustment of a laser light emission time based on settings of the value of the bias current, and wherein the adjustment control portion sets, as the amount of expansion of the pulse width, a period of time that has a length of "m" times longer than a unit amount of expansion of the pulse width where "m" is an integer equal to or greater than 1, and further, has a greatest length among lengths equal to or smaller than a required period of time for the drive current supplied to the laser light source to increase from zero to a preset value of an amount of light emission, and sets the value of the bias current in a manner to compensate a difference between the amount of expansion and the required period of time.

2. The image forming apparatus according to claim 1, comprising a temperature sensor configured to detect an operating ambient temperature of the laser light source, and a memory configured to store temperature characteristics data, the temperature characteristics data indicating a relationship between the operating ambient temperature and each of required periods of time for an oscillation threshold current value of the laser light source and the drive current to increase from zero to a preset value of an amount of light emission; wherein the state detection portion obtains the operating ambient temperature as the state data, and the adjustment control portion sets the value of the bias current and the amount of expansion of the pulse width depending on the oscillation threshold current value and the required period of time corresponding to the operating ambient temperature.

3. The image forming apparatus according to claim 1, comprising a photodetector configured to detect laser light emitted from the laser light source; wherein when the laser light source is caused to emit light, the state detection portion obtains, as the state data, an oscillation threshold current value of the laser light source and a rise time from when light emission starts until when an amount of light emission reaches a preset value, and the adjustment control portion sets, depending on the oscillation threshold current value and the rise time, the value of the bias current and the amount of expansion of the pulse width.

4. The image forming apparatus according to claim 1, comprising a photodetector configured to detect laser light emitted from the laser light source, a temperature sensor configured to detect an operating ambient temperature of the laser light source, and a memory configured to store temperature characteristics data, the temperature characteristics data indicating a relationship between the operating ambient temperature and an oscillation threshold current value of the laser light source; wherein at a predetermined time in expectation of aging of the image forming apparatus, when the laser light source is caused to emit light, the state detection portion obtains and stores, as the state data, a rise time from when light emission starts until when an amount of light emission reaches a preset value, and obtains, as the state data, the operating ambient temperature every time when the image forming apparatus forms a latent image, and every time when the image forming apparatus performs image forming operation, the adjustment control portion sets the value of the bias current and the amount of expansion of the pulse width depending on the oscillation threshold current value corresponding to the operating ambient temperature detected and the rise time stored.

5. An image forming apparatus for performing laser exposure to form a latent image on a photoconductor, the image forming apparatus comprising:

a laser light source;

a driving circuit configured to supply drive current to the laser light source in accordance with an image pulse signal depending on a dot pattern of the latent image;

a current adjustment portion configured to increase or decrease an amount of bias current, the bias current being supplied as a part of the drive current to the laser light source;

a pulse width expansion portion configured to expand a pulse width of the image pulse signal supplied to the driving circuit;

a state detection portion configured to obtain state data indicating a state related to light emission start characteristics of the laser light source; and an adjustment control portion configured to set, based on the state data, a value of the bias current and an amount of expansion of the pulse width in such a manner that laser light emission occurs in a period of time having a length equal to a length of a pulse width of each pulse in the image pulse signal, wherein the adjustment control portion sets the value of the bias current and the amount of expansion of the pulse width in such a manner that the amount of expansion of the pulse width is greater than an amount of adjustment of a laser light emission time based on settings of the value of the bias current, and wherein the adjustment control portion determines a difference between a tentative amount of expansion that has a length of "m" times longer than a unit amount of expansion of the pulse width by the pulse width expansion portion where "m" is an integer equal to or greater than 1, and further, has a greatest length among lengths equal to or smaller than a required period of time for the drive current supplied to the laser light source to increase from zero to a preset value of an amount of light emission and the required period of time, if the difference is equal to or smaller than a half of the unit amount of expansion, then the adjustment control portion sets, as the tentative amount of expansion, the amount of expansion of the pulse width, and if the difference is greater than the half of the unit amount of expansion, then the adjustment control portion sets, as the amount of expansion of the pulse width, a time having a length of (m+1) times longer than the unit amount of expansion and in either case, the adjustment control portion sets the value of the bias current in a manner to compensate a difference between the amount of expansion set and the required period of time.

6. A method used in an image forming apparatus, the image forming apparatus including a laser light source and a driving circuit for supplying drive current to the laser light source in accordance with an image pulse signal depending on a dot pattern of a latent image formed on a photoconductor, the method for adjusting laser light emission from the laser light source for laser exposure to form the latent image comprising:

a state detection step for detecting a state related to light emission start characteristics of the laser light source; and an adjustment step for setting, based on the state of the laser light source detected in the state detection step, a value of bias current supplied as a part of the drive current to the laser light source and an amount of expansion of the pulse width in such a manner that laser light emission occurs in a period of time having a length equal to a length of a pulse width of each pulse in the image pulse signal, wherein the adjustment step sets the value of the bias current and the amount of expansion of the pulse width in such a manner that the amount of expansion of the pulse width is greater than an amount of adjustment of a laser light emission time based on settings of the value of the bias current, and wherein, in the adjustment step, a period of time is set as the amount of expansion of the pulse width, the period of time having a length of "m" times longer than a unit amount of expansion of the pulse width where "m" is an integer equal to or greater than 1, and further, having a greatest length among lengths equal to or smaller than a required period of time for the drive current supplied to the laser light source to increase from zero to a preset value of an amount of light emission, and sets the value of the bias current in a manner to compensate a difference between the amount of expansion and the required period of time.

7. The method according to claim 6, comprising a temperature detection step for detecting an operating ambient temperature of the laser light source, and a memorizing step for storing, in a memory, temperature characteristics data, the temperature characteristics data indicating a relationship between the operating ambient temperature and each of required periods of time for an oscillation threshold current value of the laser light source and the drive current to increase from zero to a preset value of an amount of light emission; wherein in the state detection step, the operating ambient temperature is obtained as the state data, and in the adjustment step, the value of the bias current and the amount of expansion of the pulse width are set depending on the oscillation threshold current value and the required period of time corresponding to the operating ambient temperature.

8. The method according to claim 6, comprising a photo detection step for detecting laser light emitted from the laser light source; wherein in the state detection step, when the laser light source is caused to emit light, an oscillation threshold current value of the laser light source and a rise time from when light emission starts until when an amount of light emission reaches a preset value are detected as the state, and in the adjustment step, depending on the oscillation threshold current value and the rise time, the value of the bias current and the amount of expansion of the pulse width are set.

9. The method according to claim 6, a photo detection step for detecting laser light emitted from the laser light source, a temperature detection step for detecting an operating ambient temperature of the laser light source, and a memorizing step for storing temperature characteristics data, the temperature characteristics data indicating a relationship between the operating ambient temperature and an oscillation threshold current value of the laser light source; wherein in the state detection step, at a predetermined time in expectation of aging of the image forming apparatus, when the laser light source is caused to emit light, a rise time from when light emission starts until when an amount of light emission reaches a preset value is detected and stored as the state, and, the operating ambient temperature is detected as the state every time when the image forming apparatus forms a latent image, and in the adjustment step, every time when the image forming apparatus performs image forming operation, the value of the bias current and the amount of expansion of the pulse width are set depending on the oscillation threshold current value corresponding to the operating ambient temperature detected and the rise time stored.

10. A method used in an image forming apparatus, the image forming apparatus including a laser light source and a driving circuit for supplying drive current to the laser light source in accordance with an image pulse signal depending on a dot pattern of a latent image formed on a photoconductor, the method for adjusting laser light emission from the laser light source for laser exposure to form the latent image comprising:

a state detection step for detecting a state related to light emission start characteristics of the laser light source; and an adjustment step for setting, based on the state of the laser light source detected in the state detection step, a value of bias current supplied as a part of the drive current to the laser light source and an amount of expansion of the pulse width in such a manner that laser light emission occurs in a period of time having a length equal to a length of a pulse width of each pulse in the image pulse signal, wherein the adjustment step sets the value of the bias current and the amount of expansion of the pulse width in such a manner that the amount of expansion of the pulse width is greater than an amount of adjustment of a laser light emission time based on settings of the value of the bias current, and wherein, in the adjustment step, when a difference between a tentative amount of expansion that has a length of "m" times longer than a unit amount of expansion of the pulse width by the pulse width expansion portion where "m" is an integer equal to or greater than 1, and further, has a greatest length among lengths equal to or smaller than a required period of time for the drive current supplied to the laser light source to increase from zero to a preset value of an amount of light emission and the required period of time is equal to or smaller than a half of the unit amount of expansion, then the amount of expansion of the pulse width is set as the tentative amount of expansion, and if the difference is greater than the half of the unit amount of expansion, then a time having a length of (m+1) times longer than the unit amount of expansion is set as the amount of expansion of the pulse width, and in either case, the value of the bias current is set in a manner to compensate a difference between the amount of expansion set and the required period of time.

* * * * *